US005102252A

United States Patent [19]

Chu

[11] Patent Number: 5,102,252

[45] Date of Patent: Apr. 7, 1992

[54] BINDER

[75] Inventor: Cornel Chu, London, England

[73] Assignee: Hi-Tech Industries Limited, Acton, England

[21] Appl. No.: 592,481

[22] Filed: Oct. 3, 1990

[30] Foreign Application Priority Data

Oct. 13, 1989 [GB] United Kingdom ..... 8923057
Jan. 30, 1990 [EP] European Pat. Off. ..... 90101813.5

[51] Int. Cl.[5] ..... B42F 13/04; B42F 13/40; B42F 15/04

[52] U.S. Cl. ..... 402/4; 402/17; 402/65

[58] Field of Search ..... 402/4, 14, 17, 64, 65

[56] References Cited

U.S. PATENT DOCUMENTS

| | | | |
|---|---|---|---|
| 3,776,648 | 12/1973 | Price | 402/17 |
| 4,483,637 | 11/1984 | Updegrave et al. | 402/17 X |
| 4,486,111 | 12/1984 | Hulber et al. | 402/65 X |
| 4,487,520 | 12/1984 | Maier-Hunke et al. | 402/65 |
| 4,722,626 | 2/1988 | Abildgaard | 402/4 |

FOREIGN PATENT DOCUMENTS

| | | |
|---|---|---|
| 0053576 | 2/1985 | European Pat. Off. . |
| 0192322 | 8/1986 | European Pat. Off. . |
| 968657 | 9/1964 | United Kingdom . |
| 1021605 | 3/1966 | United Kingdom . |
| 1417580 | 12/1975 | United Kingdom . |
| 1425844 | 2/1976 | United Kingdom . |
| 1462266 | 1/1977 | United Kingdom . |
| 1535304 | 12/1978 | United Kingdom . |
| 2088778 | 2/1985 | United Kingdom . |
| 2096544B | 4/1985 | United Kingdom . |

*Primary Examiner*—Paul A. Bell
*Attorney, Agent, or Firm*—Armstrong & Kubovcik

[57] ABSTRACT

A binder comprises suspension bars, each defining a channel with apertures leading into the channel adjacent the ends thereof. Flexible support elements are threaded through holes in sheets of paper to be received in the binder so that the paper is carried upon the elements. The channel in each suspension bar is formed and dimensioned so as to releasably retain the ends of each element therein without the need for separate retaining means. The binder is assembled by passing the ends of the elements through the apertures and pushing them into the channel where they are held in place.

12 Claims, 4 Drawing Sheets

BINDER

BACKGROUND OF THE INVENTION

The present invention relates to a binder and more particularly to a binder for binding together sheets of paper along one edge of the paper such that the bound sheets may be stored in a conventional suspension type storage system. It is envisaged that the invention will be utilised in order to bind together sheets of paper upon which computer data is printed where the paper is provided with regularly spaced holes along opposite edges of the paper. However, the invention is not limited to this particular application and may be utilised in order to bind together other types of paper.

There already exist on the market binders for binding together sheets of 'computer paper' in such a way that the bound paper may be stored in a suspension type storage system. A typical prior art binder is disclosed in U.K. Patent No. 1535304. This document relates to a binder for binding together loose leaf sheets, the binder comprising at least one elongated channel member and a pair of compressor members which are slidably mounted on the channel member. Loose leaf sheets are held together by a pair of flexible posts which are passed through aligned holes in the sheets, the ends of the posts being retained in position relative to the channel member by way of the compressor members. The compressor members are slidably movable along the channel between predetermined positions, in order to allow for the addition or removal of sheets from the binder. The compressor members each have a hooked end portion by way of which the assembled binder may be supported in a suspension filing system.

Further prior art binders are disclosed in U.K. Patent No. 2096544, U.K. Patent No. 1462266, U.K. Patent No. 1417580 and European Patent No. 0053576. All these prior art binders incorporate a bar which extends across the width of the binder and, in some cases, forms a suspension bar, flexible support elements which are threaded through holes in sheets of paper so that the sheets are carried by the support elements and separate means, usually located upon the bar extending across the binder, for retaining the ends of the support elements in position relative to that bar when the binder is assembled. The existing binders are of a relatively complex structure and are therefore expensive and not always simple to operate when it is desired to remove sheets from a bound set of sheets or to add further sheets to a bound set of sheets.

The present invention seeks to provide a binder which is of a simple construction and therefore relatively cheap to manufacture and which is quick and simple to use.

BRIEF SUMMARY OF THE INVENTION

According to the present invention there is provided a binder for binding together sheets of paper, the binder comprising at least one suspension bar defining a channel, the or each bar having one or more apertures extending into the channel adjacent each end of the channel; at least one elongate, flexible support element adapted to be threaded through holes in the sheets of paper so that the sheets are carried upon the support element, the or each support element and the channel being so dimensioned that the ends of the or each support element are introducable into the channel in the bar via selected apertures adjacent each end of the channel; the channel in the suspension bar being formed and dimensioned so as to releasably retain the ends of the or each support element within the channel.

Preferably the binder comprises two suspension bars and two elongate flexible support elements.

Preferably the or each suspension bar is provided with a slider received within and movable along the channel in the bar, the slider having a cam face to engage the end portions of a support element within the channel and push the support element out of the channel.

Conveniently the slider is formed with an enlarged head, the head being captively retained within a correspondingly shaped portion of the channel.

Advantageously the slider defines two cam surfaces, there being a first cam surface adapted to engage an end portion of a support element at one end of the channel in the suspension bar and a second cam surface adapted to engage the end portion of a support element received in the other end of the channel in the suspension bar.

Preferably the or each suspension bar defines a hook at each of the bar such that the bar may be supported upon rails or the like in a conventional suspension type storage system.

Conveniently the channel formed in the or each suspension bar is defined between two opposed walls of the bar, the apertures extending into the channel through one of the walls defining the channel at an oblique angle such that a support element may pass through one of the apertures and out through an open mouth of the channel without engaging the opposite wall of the channel.

Conveniently the apertures extending into the channel each define an edge constituting a tooth which engages and grips the end portion of the support element when the end portion of the support element is received within the channel.

Advantageously said tooth formed at an edge of an aperture extending into the channel and an inwardly directed projection formed upon a wall defining the channel serve to releasably retain the end portions of the or each support element within the channel, the cross-sectional width of the channel being approximately equal to the cross-sectional width of the support element, the walls defining the channel being formed of a resilient material so as to enable the end portion of the support element to be forced past the projection into the channel, the support element then being retained within the channel behind the projection.

The or each suspension bar may carry a flexible plastics sheet which forms a protective cover over an outermost sheet of paper retained within the binder.

The or each suspension bar may also be provided with a cover mounted upon the bar, the cover serving to retain an index card upon the bar.

DETAILED DESCRIPTION OF PREFERRED EMBODIMENTS

Figure 1:
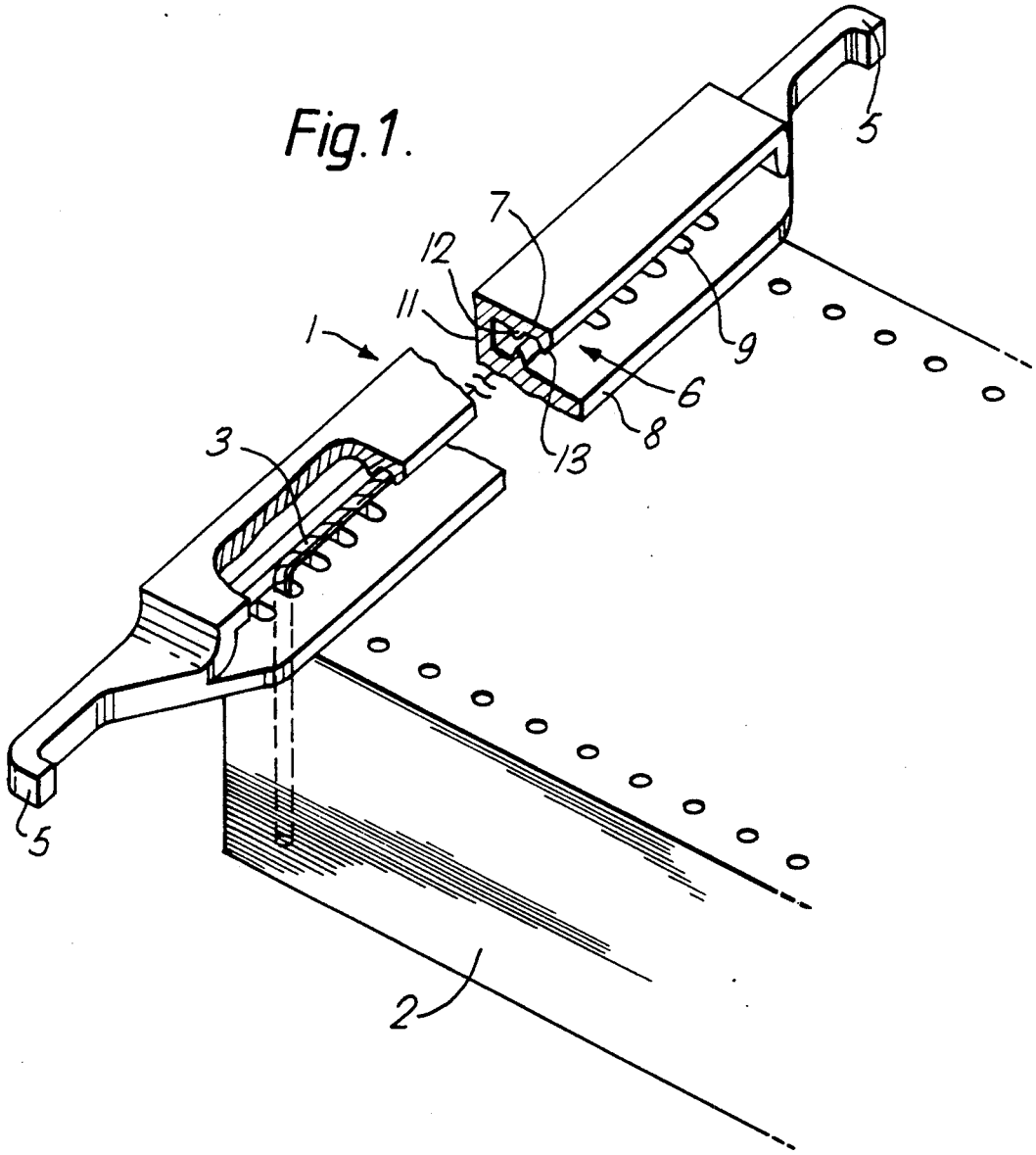
FIG. 1 is a partly cut-away perspective view illustrating part of a binder in accordance with the present invention.

The binder comprises a pair of suspension bars 1, each adapted to be positioned along the edge of a stack of paper 2 such that the suspension bars lie opposite one another and a pair of flexible plastic cords each of which is threaded through holes formed adjacent the edge of the stack of paper. The free ends of the plastic cords are each retained within a channel formed in a respective suspension bar 1. The channel in each suspension bar also accommodates a slider 4 which may be moved along the channel in order to eject the end of the cord 3 from the channel and thereby release the binder. The paper is therefore supported by the plastic cords, the free ends which are firmly clamped in channels within the suspension bars.

Dealing with the components of the binder in turn, the suspension bars 1 are each formed as an elongate integrally formed member defining a hook 5 adjacent each end and having a central region which defines a channel between a relatively short front wall 7 and a slightly longer rear wall 8. The channel 6 is closed at its opposite ends, but has an open mouth extending along one side of the suspension bar.

Adjacent the ends of the channel 6 the suspension bar 1 defines a plurality of apertures 9 which extend through the rear wall 8 at an oblique angle such that the aperture is directed towards the open mouth of the channel 6. As can be most clearly seen in FIG. 2 of the drawings, the uppermost edge of each aperture 9, at a position located immediately adjacent the channel 6, defines a tooth 10 which engages the plastic cord when the binder is assembled. In the embodiment illustrated in FIG. 1 of the drawings five apertures 9 are provided at each end of the channel 6. It will be appreciated however that a different number of apertures may be provided. It is desirable to provide a plurality of apertures at each end of the channel in order to enable the binder to be utilised in binding together sheets of paper of differing widths.

The internal surfaces of the walls defining the channels 6 are formed with a plurality of inwardly directed projections which extend along the length of the channel. Thus, the rear wall carries an inwardly directed projection 11 which runs along the length of the wall and passes immediately adjacent the upper edge of each aperture 9. Thus the projection 11 forms a part of the tooth 10 at positions adjacent the apertures 9. The front wall 7 is formed with a first inwardly directed projection 12 disposed immediately opposite the projection 11 but with a gap therebetween and a second inwardly directed projection 13 which extends along the free edge of the front wall. The projections 11, 12, 13 are most clearly visible in FIG. 2 of the drawings.

Figure 2:
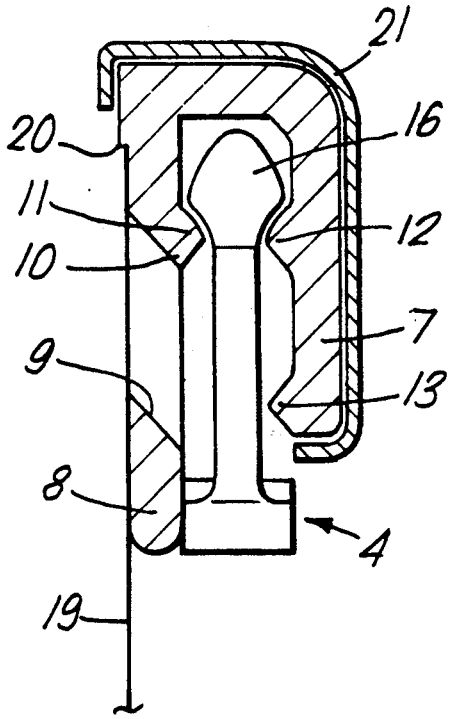
FIG. 2 is a cross-sectional view through a suspension bar forming part of the binder, illustrating a slider element within the suspension bar.
Figure 3:
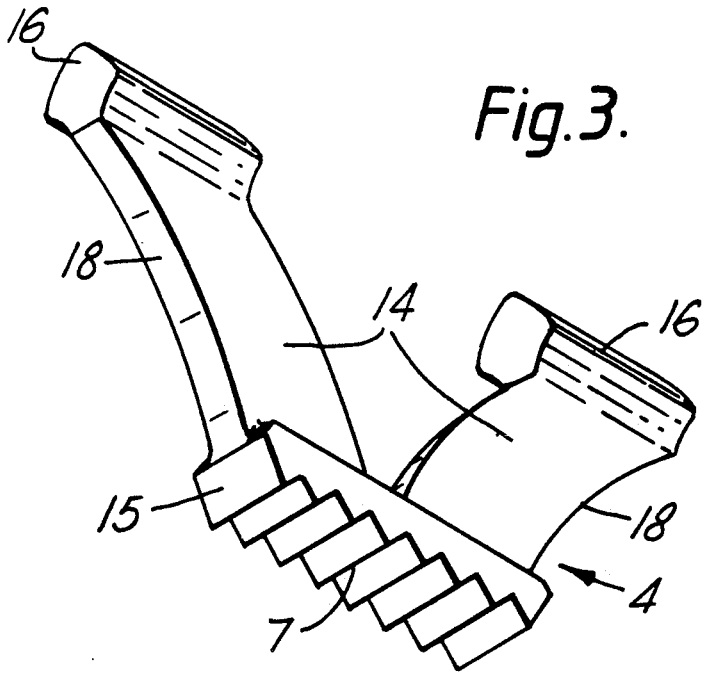
FIG. 3 is a perspective view of the slider element shown within the suspension bar in FIG. 2.
Figure 4:
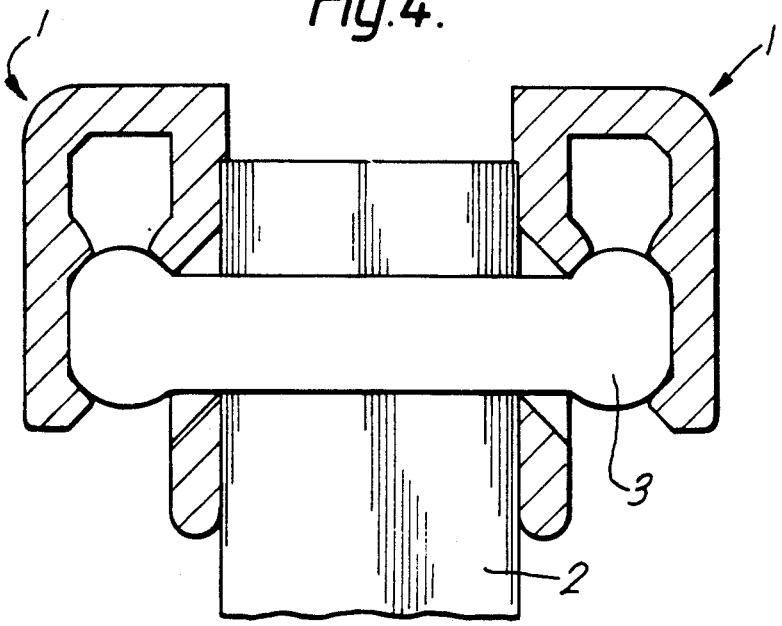
FIG. 4 is a cross-sectional view through a binder in accordance with the present invention.

The slider which is dimensioned to be received within the channel 6, is shown in FIG. 3 of the drawings and comprises a generally U-shaped, symmetrical element having arms 14 and a base 15. The ends of the arms of the slider are each formed as an enlarged head 16. The head 16 is dimensioned to be received within the space between the base of the channel 6 and the opposed projections 11, 12 with sufficient clearance to enable it to slide along the channel. The head 16 on each arm of the slider is introduced into the channel by forcing the head between the projections 11, 12. The front wall 7 is sufficiently resilient to flex outwardly and allow the heads to pass between the projections. As can be clearly seen from FIG. 2 of the drawings the head 16 formed on each arm is shaped so as to cooperate with the surfaces of the projections 11, 12. The base 15 of the slider is formed with serrations 17 or the like to facilitate manually pushing the slider along the channel, for example by engaging the serrations 17 with a thumb or finger. The end surfaces 18 of the arms of the slider are arcuate and each form a cam surface which engages the plastic cord in the channel 6 when it is desired to release the binder, as will be described in further detail hereinafter.

The plastic cords are dimensioned such that they will pass through the apertures 9 formed in the wall 8 and such that they will be a tight fit in the space within the channel 6 between the projections 11, 12 and the projection 13 adjacent the open mouth of the channel.

The rear wall 8 of each suspension bar carries a thin pvc sheet 19 which serves, when the binder is assembled, to form a protective cover over the outermost sheet of paper in a bound bundle of papers. The rear wall 8 of the suspension bar may be formed with a small step 20 such that the pvc sheet is received within the recessed part of the rear wall formed by the step. It is envisaged that the suspension bars and sliders will be formed from hard pvc and that the soft pvc cover 19 may be welded onto the rear of the suspension bar wall 8.

A transparent cover 21 is provided which may be snap-fitted over the front wall 7 and that part of the suspension bar which defines the base of channel 6, as shown in FIG. 2. An index card may be received beneath the transparent cover 21. The card may be marked so as to identify information contained in the data sheets which are bound together in one particular binder.

In use a single binder may comprise two suspension bars 1, two plastic cords and two sliders In order to assemble the binder, the sliders 4 are each introduced into the channel 6 of a respective suspension bar by forcing the head 16 of the slider past the projections 11, 12 such that the slider is then held captive within the channel. Each slider is located substantially centrally of the respective suspension bar. The main body of the slider extends down and out of the open mouth of the channel such that the base is disposed below the free edge of the front wall 7 and is freely accessible. The plastic cords 3 are each threaded through holes formed at the edges of the sheets of paper which are to be bound together such that the cords serves to interconnect the sheets of paper adjacent one edge thereof.

The free ends of each cord are passed through an aperture 9 in a respective suspension bar. The apertures 9 are formed at such an angle that the end of the cord will pass beyond the free edge of the front wall 7 i.e. the free end of the cord will extend out through the open mouth of the channel. The protruding end portion of each cord is then pushed up into the channel in the space between the projections 11, 12 and the projection 13, so that the end portion extends axially along the channel towards the slider. As mentioned above the suspension bars are formed from a material which is sufficiently resilient to enable the front wall 7 to flex outwardly to enable the cord to pass behind the projection 13. Once the cord has been forced behind the projection 13 the wall 7 returns to its normal position and the cord is retained in position behind the projection 13.

The part of the cord adjacent the aperture 9 is bent through an angle of approximately 90° when it is pushed into the channel and the tooth 10 formed at the edge of the aperture 9 'bites into' the plastic cord and, in combination, the tooth 10 and the projections formed within the channel 6 serve to grip the cord and retain it within the channel. During this procedure the slider is located in a central region of the channel remote from the apertures 9 at the opposite ends of the channel. It will therefore be appreciated that the channel in each suspension bar is formed and dimensioned so as to releasably retain the ends of each support element within the channel without the need for any separate retaining means.

When it is desired to release the binder the slider 4 may be moved along the channel until the cam surface 18 engages the end of the cord. As the slider is pushed further along the channel the cord is forced towards the open mouth of the channel past the projection 13, the wall 7 again flexing outwardly in order to permit the cord to pass out of the open mouth of the channel. The slider may be moved along the channel to both ends thereof in order to release both cords from the channel whereupon the suspension bar may be lifted away from a stack of paper such that the cords pass back out through the apertures 9. It is now possible to add more paper by passing the cords 3 through holes formed in the edges of the additional sheets of paper or to remove paper from the stack of bound sheets. In order to reassemble the binder the ends of the cords are again passed through the apertures 9 formed in the suspension bar and are secured within the channel 6 in the manner as described above.

It will be appreciated that the assembly of the binder and the procedure for releasing the binder is both quick and simple. When assembled the binder may be supported in a conventional suspension type storage system by locating the hooks upon rails or the like provided in the storage system.

Whilst in the embodiment described above the binder comprises two suspension bars and two cords, it would be possible to operate the binder with two suspension bars and a single cord. In this case one of the suspension bars would be provided with a slider whilst the other suspension bar would not have a slider. In this case the single cord could pass along the full length of one suspension bar with the ends of the cord passing up through holes in the sheets which are to be bound together and into the other suspension bar with the ends being retained in the channel in the manner as described above.

It may also prove possible to form the binder by utilising a single suspension bar and one cord if the cord passes behind the sheets of paper to be bound together with the free ends of the cord again passing up through holes formed in the edges of the sheets of paper and then being received within the channel of the single suspension bar in the manner as described above.

Figure 6:
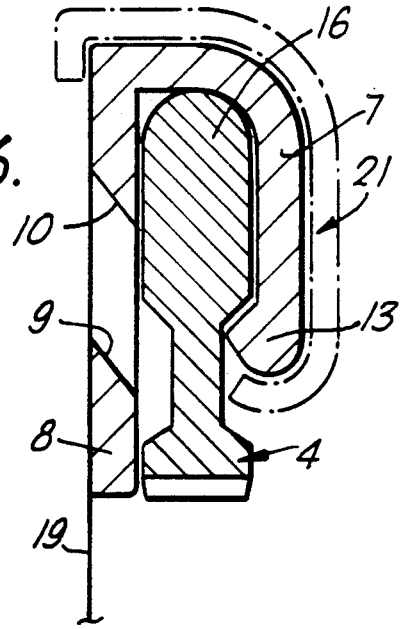
FIG. 6 corresponds to FIG. 2 but illustrates the modified, preferred design.
Figure 7:
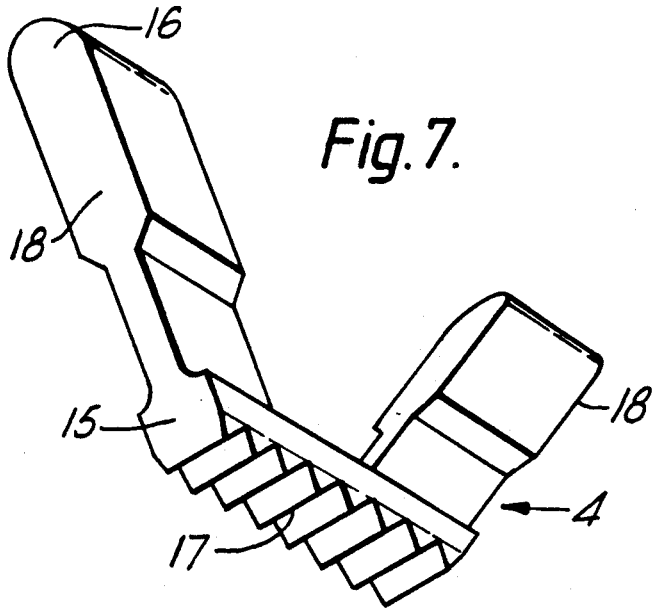
FIG. 7 is a perspective view corresponding to FIG. 3, illustrating the modified, preferred design of slider element.
Figure 5:
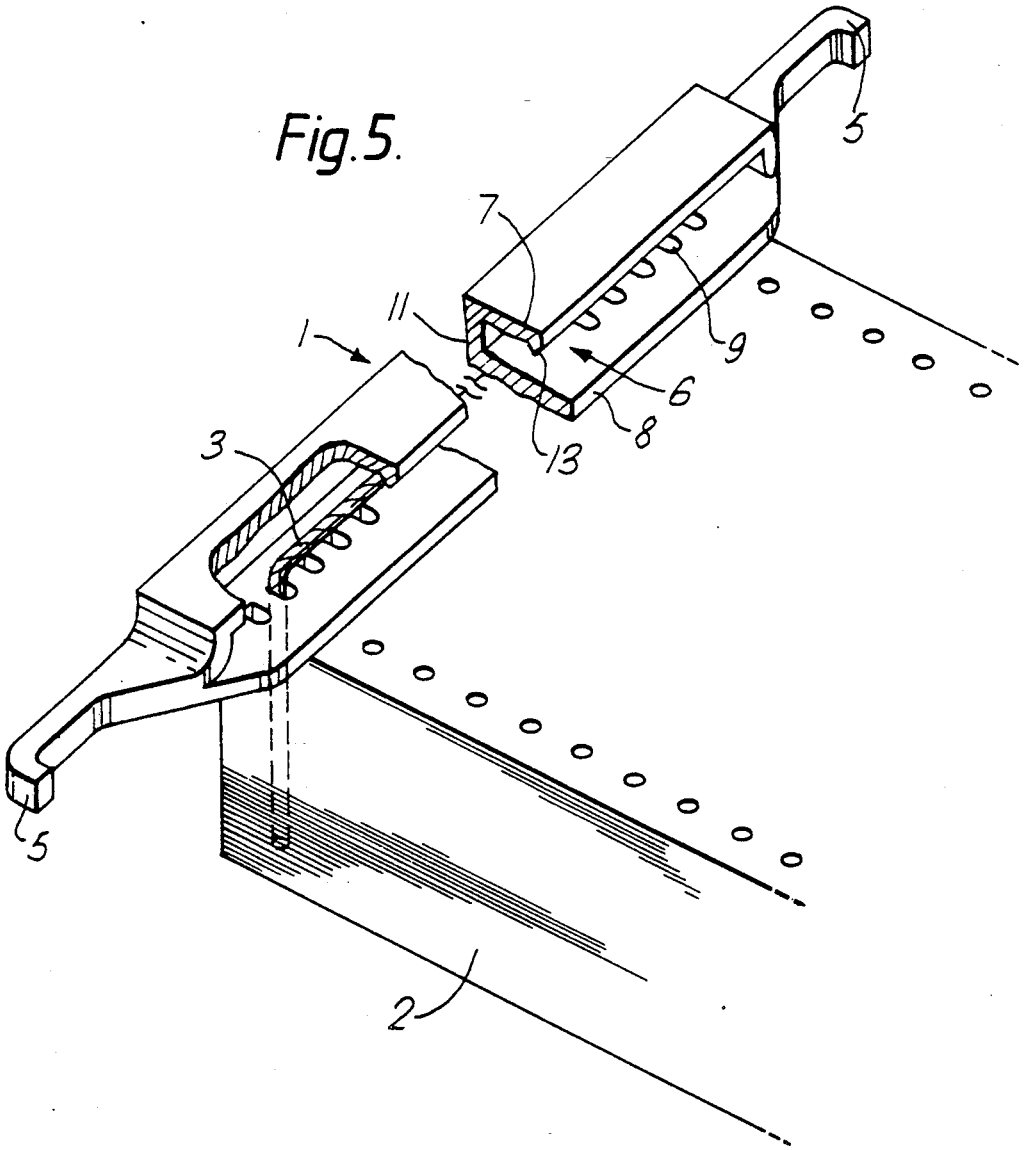
FIG. 5 is a perspective view corresponding to FIG. 1 but illustrating a modified, preferred design.

FIGS. 5, 6 and 7 illustrate a slightly modified and, from a manufacturing point of view, preferred design for the suspension bar 1 and the slider element 4. The modified design is very similar to that of FIGS. 1 to 4 and for ease of description the same reference numerals will be used for parts which are common to both designs.

The only difference between the suspension bar shown in FIG. 5 and that of FIG. 1 is that the modified bar only incorporates one inwardly directed projection 13 extending along the free edge of the front wall 7 of the bar. Thus, the inwardly directed projections 11, 12 are omitted. The inwardly directed projection 13 terminates at a point spaced from each end of the channel 6. The modified design of the suspension bar facilitates manufacture of the bar as a plastics moulding. Thus, the flexibility of the walls 7, 8 defining the channel 6 and the fact that the projection 13 terminates at a position spaced from the ends of the channel enables the suspension bar to be released from the moulding tool, part of which is, of course, received within the channel 6 during the moulding process. As the suspension bar is released from the moulding tool the front wall 7 flexes outwardly so as to enable the removal of the tool from the channel 6. Clearly the injection moulding of the design illustrated in FIG. 1 of the drawings would be very difficult, if not impossible, to perform at reasonable expense.

In all other respects the suspension bar illustrated in FIG. 5 is the same as that illustrated in FIG. 1 of the drawings and thus no further description of the remainder of the bar is necessary at this point.

The modifications to the suspension bar give rise to minor modifications to the slider element 4, as may be seen from FIGS. 6 and 7. The modified slider element 4 is of the same generally shape as that shown in FIG. 3 but has a longer head 16 formed at each end of the element, the heads 16 extending up from the base 15. As with the slider element of FIG. 3, the modified slider element is inserted into the channel 6 defined by the suspension bar by forcing the head 16 past the projection 13 into the channel. The front wall 7 of the bar is sufficiently flexible to permit the insertion of the heads 16 into the channel. The lower edge of each head 16 is configured so as to engage and rest upon the upper portion of the inwardly directed projection 13 when received in the channel. The end surfaces 18 of the slider element are not arcuate as with the element of FIG. 3 but are planar surfaces. However, the heads 16 formed at each end of the slider element diverge away from one another as they extend away from base 15 and the end surfaces 18 still form a cam surface which engages the plastic cord 3 in the channel 6 when it is desired to release the binder.

In use the modified binder operates in precisely the same manner as described above in relation to FIGS. 1 to 4. Thus when the binder is assembled the free ends of each cord 3 are pushed up into the channel 6 and are retained within the channel by the projection 13 and by the tooth 10 formed at the edge of the aperture 9 through which the cord passes. The binder is released by moving the slider element 4 along the channel so that the end surface 18 engages the end of each cord 3 and forces the end out of the channel.

The suspension bar may, of course, be of any desired length and it is envisaged that various lengths of bar will be marketed in order to match existing, conventional paper widths.

It will be appreciated that various modifications may be made to the above-described embodiment of binder without departing from the scope of the present invention.

What is claimed is:

1. A binder for binding together sheets of paper, the binder comprising at least one suspension bar defining a channel, said channel extending across substantially the full length of said bar, the or each bar having one or more apertures extending through a part of the bar adjacent each end of the channel; at least one elongate, flexible support element adapted to be threaded through holes in the sheets of paper so that the sheets are carried upon the support element, the or each support element and the channel being so dimensioned that the ends of the or each support element are introducible into the channel in the bar via selected apertures adjacent each end of the channel; the channel in the suspension bar having a cross-sectional width approximately equal to the cross-sectional width of the or each support element, so as to releasably retain the ends of the or each support element within the channel.

2. A binder according to claim 1 wherein the binder comprises two suspension bars and two elongate flexible support elements.

3. A binder according to claim 1 wherein the or each suspension bar is provided with a slider received within and movable along the channel in the bar, the slider having a cam face to engage the end portion of a support element within the channel and push the support element out of the channel.

4. A binder according to claim 3 wherein the slider is formed with an enlarged head, the head being captively retained within a correspondingly shaped portion of the channel.

5. A binder according to claim wherein the slider defines two cam surfaces, there being a first cam surface adapted to engage an end portion of a support element at one end of the channel in the suspension bar and a second cam surface adapted to engage the end portion of a support element received in the other end of the channel in the suspension bar.

6. A binder according to claim 1 wherein the channel formed in the or each suspension bar is defined between two opposed walls of the bar, the apertures extending into the channel through one of the walls defining the channel at an oblique angle such that a support element may pass through one of the apertures and out through an open mouth of the channel without engaging the opposite wall of the channel.

7. A binder according to claim 1 wherein the apertures each define an edge constituting a tooth which engages and grips the end portion of the support element when the end portion of the support element is received within the channel.

8. A binder according to claim 7 wherein said tooth formed at an edge of an aperture and an inwardly directed projection formed upon a wall defining the channel serve to releasably retain the end portions of the or each support element with the channel, the walls defining the channel being formed of a resilient material so as to enable the end portion of the support element to be forced past the projection into the channel, the support element then being retained within the channel behind the projection.

9. A binder according to claim 1 wherein the or each suspension bar carries a flexible plastics sheet which forms a protective cover over an outermost sheet of paper retained within the binder.

10. A binder according to claim 1 wherein the or each suspension bar is provided with a cover mounted upon the bar, the cover serving to retain an index card upon the bar.

11. A binder for binding together sheets of paper, the binder comprising at least one suspension bar defining a channel, the channel defined by the or each suspension bar being defined between two opposed walls of the bar, the or each bar having one or more apertures extending through one of the said walls into the channel adjacent each end of the channel; at least one elongate, flexible support element adapted to be threaded through holes in the sheets of paper so that the sheets are carried upon the support element, the or each support element and the channel being so dimensioned that the ends of the or each support element are introducible into the channel in the bar via selected apertures adjacent each end of the channel, the apertures extending into the channel at an oblique angle such that a support element may pass through one of the apertures and out through an open mouth of the channel without engaging the opposite wall of the channel; the channel in the suspension bar being formed and dimensioned so as to releasably retain the ends of the or each support element within the channel.

12. A binder for binding together sheets of paper, the binder comprising at least one suspension bar defining a channel, the or each bar having one or more apertures extending through a part of the bar adjacent each end of the channel; at least one elongate, flexible support element adapted to be threaded through holes in the sheets of paper so that the sheets are carried upon the support element, the or each support element and the channel being so dimensioned that the ends of the or each support element are introducible into the channel in the bar via selected apertures adjacent each end of the channel; the channel in the suspension bar having a cross-sectional width approximately equal to the cross-sectional width of the or each support element so as to releasably retain the ends of the or each support element within the channel; the or each suspension bar being provided with a slider received within and movable along the channel in the bar, the slider having a cam face to engage the end portion of a support element within the channel and push the support element out of the channel.

* * * * *